US012320279B1

(12) United States Patent
Li et al.

(10) Patent No.: US 12,320,279 B1
(45) Date of Patent: Jun. 3, 2025

(54) STRUCTURE OF OIL CHANNEL OF OIL FILTER BASE ASSEMBLY IN VEHICLE

(71) Applicant: WENZHOU BONAI AUTO RADIATOR CO., LTD., Wenzhou (CN)

(72) Inventors: Guang Li, Wenzhou (CN); Mingzheng Tao, Wenzhou (CN); Qi Ke, Wenzhou (CN)

(73) Assignee: WENZHOU BONAI AUTO RADIATOR CO., LTD., Wenzhou (CN)

( * ) Notice: Subject to any disclaimer, the term of this patent is extended or adjusted under 35 U.S.C. 154(b) by 0 days.

(21) Appl. No.: 18/792,531

(22) Filed: Aug. 1, 2024

(30) Foreign Application Priority Data

Jul. 8, 2024 (CN) ..... 202421601204.6

(51) Int. Cl.
*F01M 11/03* (2006.01)
*F01M 1/10* (2006.01)
*F01M 5/00* (2006.01)

(52) U.S. Cl.
CPC ..... *F01M 11/03* (2013.01); *F01M 1/10* (2013.01); *F01M 5/002* (2013.01); *F01M 2001/1092* (2013.01); *F01M 2011/033* (2013.01)

(58) Field of Classification Search
CPC ..... F01M 5/002; F01M 11/03; F01M 2001/1092; F01M 2011/033
See application file for complete search history.

(56) References Cited

U.S. PATENT DOCUMENTS

| | | | | |
|---|---|---|---|---|
| 4,423,708 | A * | 1/1984 | Sweetland | F01P 11/08 123/196 R |
| 5,477,817 | A * | 12/1995 | Hufendiek | F01M 11/03 123/196 AB |
| 8,186,328 | B2 * | 5/2012 | Kiemlen | F01M 5/002 123/41.31 |
| 10,473,402 | B2 * | 11/2019 | Coban | B01D 35/18 |
| 12,059,642 | B1 * | 8/2024 | Lin | B01D 35/18 |
| 12,078,090 | B1 * | 9/2024 | Le | F01M 11/03 |
| 2004/0132359 | A1 * | 7/2004 | Tanaka | B63H 21/14 440/88 L |

(Continued)

FOREIGN PATENT DOCUMENTS

| | | |
|---|---|---|
| CN | 201826917 U | 5/2011 |
| CN | 202081990 U | 12/2011 |

(Continued)

*Primary Examiner* — Minh Truong
(74) *Attorney, Agent, or Firm* — Nitin Kaushik

(57) ABSTRACT

The present invention discloses an improved structure of an oil channel of an oil filter base assembly in a vehicle, including an oil filter base, where a lower portion of the oil filter base is provided with an oil inlet, an oil outlet, and an oil return port, an end portion of the oil filter base is provided with an antifreeze solution water inlet, a bottom portion is provided with a first water outlet and a second water outlet that are communicated with the antifreeze solution water inlet, a filter cartridge and a bypass valve are mounted in one end of the oil filter base, a filter cover is connected to an end portion of one end, close to the bypass valve, of the oil filter base, an oil cooler is mounted on an upper portion of one end, away from the filter cartridge, of the oil filter base.

10 Claims, 6 Drawing Sheets

(56) References Cited

U.S. PATENT DOCUMENTS

| | | | | |
|---|---|---|---|---|
| 2006/0096556 | A1* | 5/2006 | Groddeck | F01M 5/005<br>123/196 AB |
| 2009/0038580 | A1* | 2/2009 | Hamilton | F28F 3/048<br>29/890.035 |
| 2022/0056823 | A1* | 2/2022 | Kelly | F01M 11/03 |
| 2023/0287813 | A1* | 9/2023 | Chen | B60K 11/04 |

FOREIGN PATENT DOCUMENTS

| | | | |
|---|---|---|---|
| CN | 202100295 | U | 1/2012 |
| CN | 202745959 | U | 2/2013 |

* cited by examiner

STRUCTURE OF OIL CHANNEL OF OIL FILTER BASE ASSEMBLY IN VEHICLE

TECHNICAL FIELD

The present invention relates to an oil filter base in a vehicle, and in particular, to an improved structure of an oil channel of an oil filter base assembly in a vehicle.

BACKGROUND

At present, the product is a plastic base early in the market and is made of PA66+GF35. In addition, the product adopts a plastic plug soldering structure process. Since the product is mounted at a lower end of an engine, which belongs to a high-temperature working environment, the market feeds back conditions that the product has a short service cycle, there are more customer complaints, the plastic member is not resistant to hydrolysis, not resistant to high temperature, and poor in thermal stability, resulting in early aging failure, and the soldering plug has defects of oil leakage and desoldering. Product quality and grade are affected. An original aluminium base (an oil filter base) is internally provided with an oil channel, which is far away from an oil cooler, resulting in a poor cooling effect.

SUMMARY

The technical problem to be solved by the present invention is to provide an improved structure of an oil filter base in a vehicle according to the deficiencies of the prior art.

In order to realize the above purpose, the present invention adopts the following measures:

An improved structure of an oil channel of an oil filter base assembly in a vehicle is provided and includes an oil filter base, where a lower portion of the oil filter base is provided with an oil inlet, an oil outlet, and an oil return port, an end portion of the oil filter base is provided with an antifreeze solution water inlet, a bottom portion is provided with a first water outlet and a second water outlet that are communicated with the antifreeze solution water inlet, a filter cartridge and a bypass valve are mounted in one end of the oil filter base, a filter cover is connected to an end portion of one end, close to the bypass valve, of the oil filter base, an oil cooler is mounted on an upper portion of one end, away from the filter cartridge, of the oil filter base, and a front side face of the oil filter base is provided with an end-face inclined-hole main oil channel communicated with an internal oil channel.

An upper end face of the oil filter base is provided with an auxiliary oil channel, and the end-face inclined-hole main oil channel is communicated with the auxiliary oil channel.

A filter cover sealing ring is sleeved on the filter cover.

The oil inlet is provided with an oil inlet sealing ring, and the oil outlet is provided with an oil outlet sealing ring. The first water outlet and the second water outlet are both provided with water outlet sealing rings, and the oil return port is provided with an oil return port sealing ring.

The oil filter base is provided with an oil return process hole, the oil return process hole is provided with an oil return port blocking screw, and an end-face inclined-hole main oil channel blocking screw is connected to an outer end port of the end-face inclined-hole main oil channel.

The oil cooler is fixed on the oil filter base through a fastening bolt, the oil filter base is provided with a mounting hole, and a base mounting screw rod is disposed in the mounting hole and is connected to an engine.

A flow port between the oil cooler and the oil filter base is provided with a cooler sealing ring.

A temperature sensor and a pressure sensor are mounted at one end, away from the filter cover, of the oil filter base.

The oil filter base is made of aluminium magnesium alloy.

The auxiliary oil channel is provided with a sealing groove along an edge, and an auxiliary oil channel sealing ring is pressed in the sealing groove.

The oil filter base is of an L-shaped integral structure.

Beneficial effects of the present invention: a structure is novel, a process hole oil channel and bolt plug blocking structure on a back end is improved to a structure of the end-face inclined-hole main oil channel on a front side, and the base auxiliary oil channel that is in an original aluminium base is improved to a structure in which a channel added on the upper end face of the base is used as a new auxiliary oil channel. The channel added on the upper end face of the base is used as the new auxiliary oil channel which is used as a carrier for connection, to implement oil auxiliary supply of the engine and accelerate to cool a connection effect with an oil passage, thereby effectively reducing a risk of high-temperature failure occurring in a long-time driving process of a vehicle, increasing a product service life, reducing a product market failure rate, and improving product quality and grade.

DETAILED DESCRIPTION OF THE EMBODIMENTS

Figure 1:
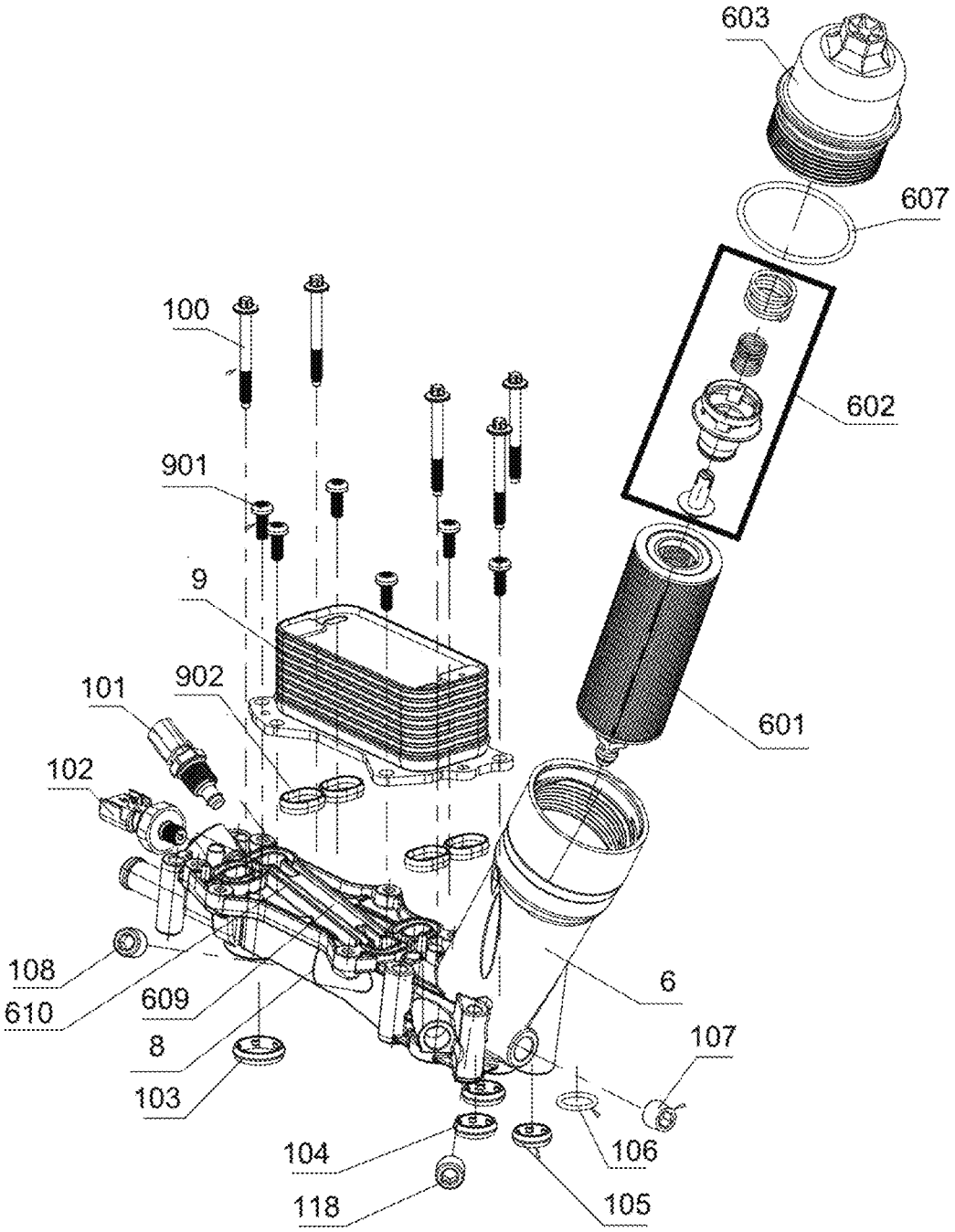
FIG. 1 is a schematic structural exploded view of the present invention.
Figure 2:
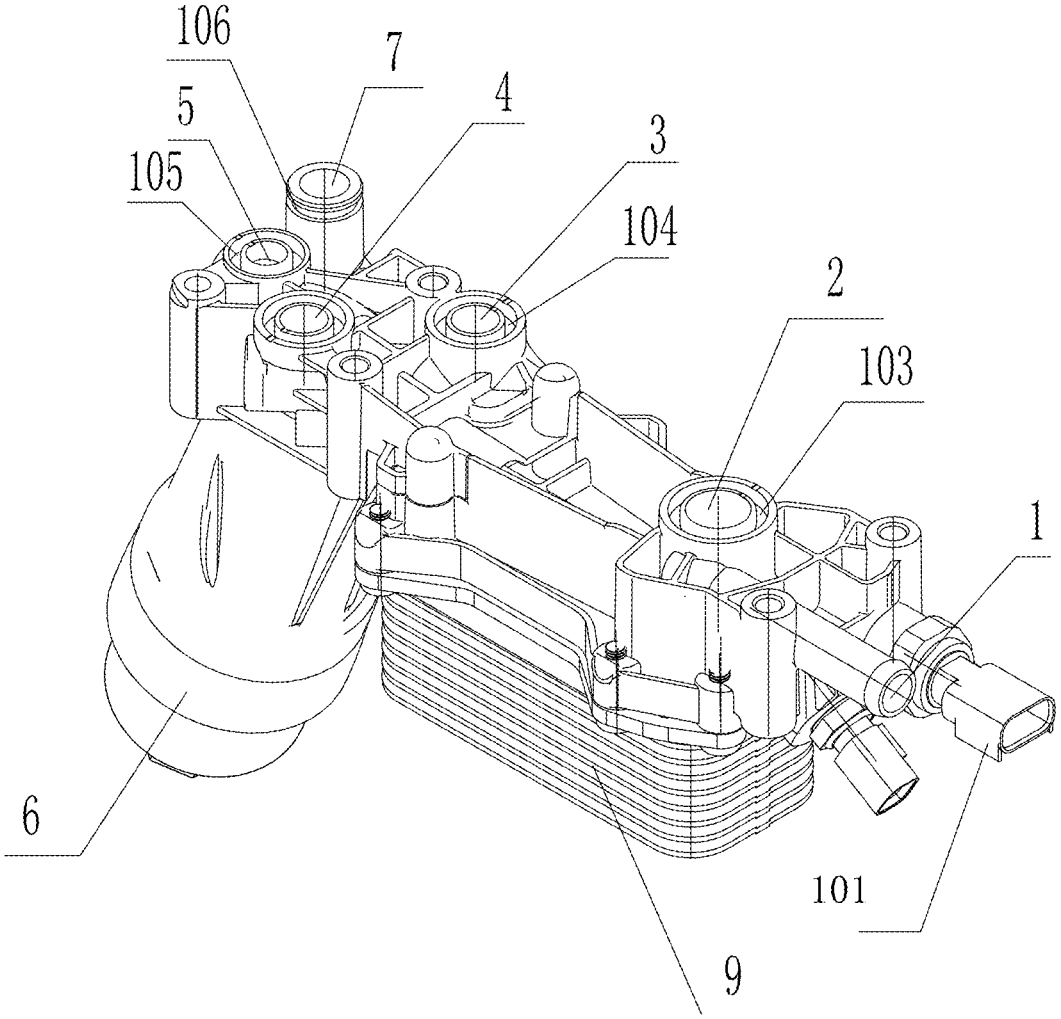
FIG. 2 is a schematic structural diagram of a lower side of the present invention.
Figure 3:
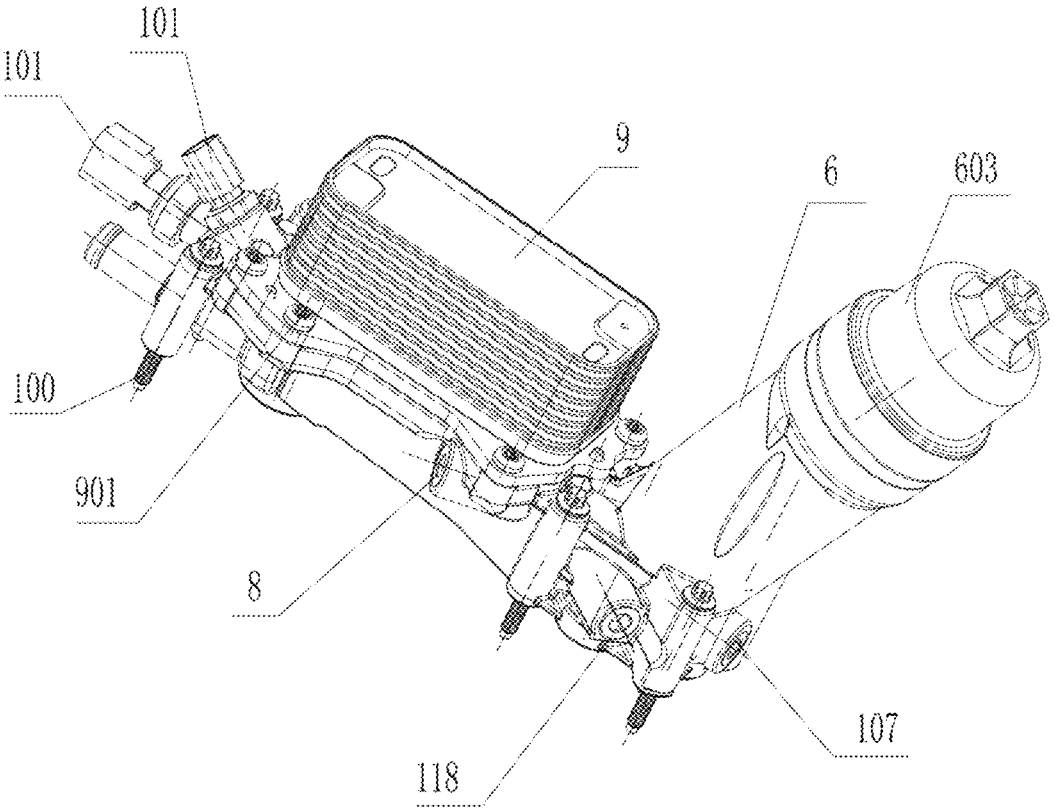
FIG. 3 is a schematic structural diagram of an upper side of the present invention.
Figure 4:
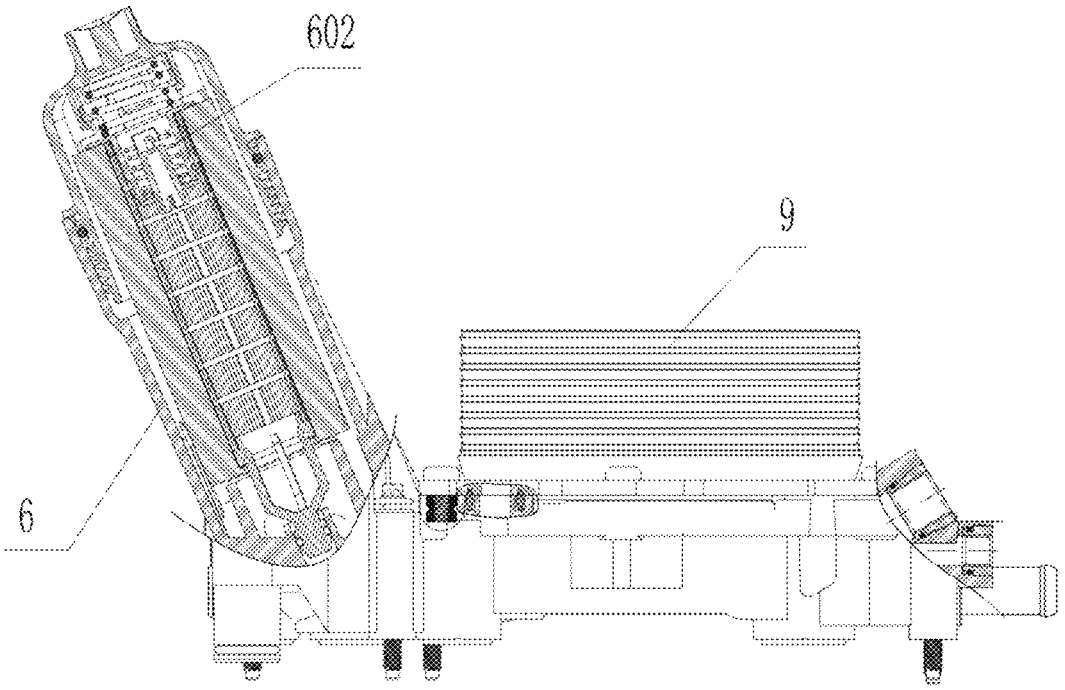
FIG. 4 is a schematic structural sectional view of a bypass valve of the present invention.
Figure 5:
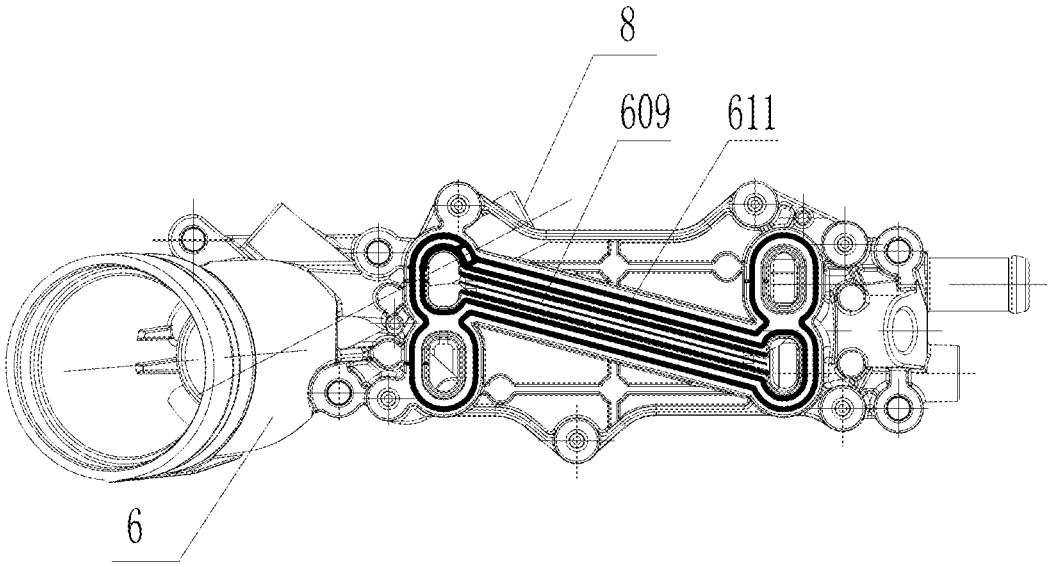
FIG. 5 is a schematic structural sectional view of an auxiliary oil channel of the present invention.
Figure 6:
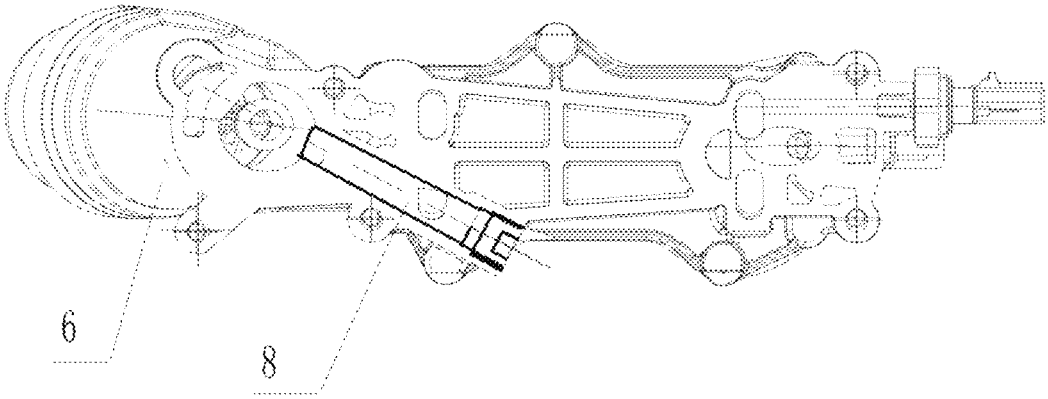
FIG. 6 is a schematic structural sectional view of an end-face inclined-hole main oil channel of the present invention.

An improved structure of an oil channel of an oil filter base assembly in a vehicle is provided and includes an oil filter base 6, where a lower portion of the oil filter base 6 is provided with an oil inlet 7, an oil outlet 2, and an oil return port 5, an end portion of the oil filter base 6 is provided with an antifreeze solution water inlet 1, a bottom portion is provided with a first water outlet 3 and a second water outlet 4 that are communicated with the antifreeze solution water inlet 1, a filter cartridge 601 and a bypass valve 602 are mounted in one end of the oil filter base 6, a filter cover 603 is connected to an end portion of one end, close to the bypass valve 602, of the oil filter base 6, an oil cooler 9 is mounted on an upper portion of one end, away from the filter cartridge 601, of the oil filter base 6, and a front side face of the oil filter base 6 is provided with an end-face inclined-hole main oil channel 8 communicated with an internal oil channel.

An upper end face of the oil filter base 6 is provided with an auxiliary oil channel 609, and the end-face inclined-hole main oil channel 8 is communicated with the auxiliary oil channel 609.

An improved structure of an oil channel of an oil filter base assembly in a vehicle is provided and includes an oil filter base 6, where a lower portion of the oil filter base 6 is provided with an oil inlet 7, an oil outlet 2, and an oil return port 5, an end portion of the oil filter base 6 is provided with an antifreeze solution water inlet 1, a bottom portion is provided with a first water outlet 3 and a second water outlet 4 that are communicated with the antifreeze solution water inlet 1, a filter cartridge 601 and a bypass valve 602 are mounted in one end of the oil filter base 6, a filter cover 603 is connected to an end portion of one end, close to the bypass valve 602, of the oil filter base 6, an oil cooler 9 is mounted on an upper portion of one end, away from the filter cartridge 601, of the oil filter base 6, a face, in contact with the oil cooler 9, of the oil filter base 6 is provided with an auxiliary oil channel 609, a front side face of the oil filter base 6 is provided with an end-face inclined-hole main oil channel 8, and the end-face inclined-hole main oil channel 8 is communicated with the auxiliary oil channel 609.

An improvement of the solution of the present invention is as follows: a new structure of a new main oil channel (the end-face inclined-hole main oil channel 8)+a base auxiliary oil channel (the auxiliary oil channel 609) is designed in the oil filter base 6. Specifically, a process hole oil channel and bolt plug blocking structure on a back end is improved to the end-face inclined-hole main oil channel 8 on a front side of the oil filter base 6, and the base auxiliary oil channel that is in an original aluminium base (the oil filter base 6) is improved to the auxiliary oil channel 609 that is disposed on the face, in contact with the oil cooler 9, of the oil filter base 6. The auxiliary oil channel 609 on the upper end face (the face in contact with the oil cooler 9) of the oil filter base 6 is used as a carrier for connection, to implement oil auxiliary supply of an engine and accelerate to cool a connection effect with an oil passage.

The original aluminium base (the oil filter base 6) is internally provided with an oil channel, which is far away from the oil cooler 9, resulting in a poor cooling effect. After improvement of the solution of the present application, two auxiliary oil channels 609 are disposed in parallel, and the auxiliary oil channels 609 are closely in contact with the oil cooler 9, so that the cooling effect is better, thereby improving cooling efficiency.

Functional principle specification:

Oil passage: engine oil enters into a whole oil filter assembly from the oil inlet 7, is filtered by the filter cartridge 601, (the bypass valve 602 is internally disposed) then enters the oil cooler 9 through the end-face inclined-hole main oil channel 8 for cooling (the oil may also be cooled and directly return to the engine through the auxiliary oil channel 609), and the filtered and cooled oil returns to the engine for lubricating from the oil outlet 2. When the filter cartridge 601 is changed, internal redundant oil returns to the engine from the oil return port 5.

Water passage: a whole vehicle antifreeze solution enters into the oil filter base assembly (the oil filter base 6) from the antifreeze solution water inlet 1, then enters into the oil cooler 9 to take away the heat of high-temperature oil of the engine for cooling, and then returns to a whole vehicle circulating cooling system and an air conditioning system respectively through the first water outlet 3 and the second water outlet 4.

Innovation points of the present invention: according to the new structure of the main oil channel (A8)+the base auxiliary oil channel of the BN-1394 oil filter base of the company, the process hole oil channel and bolt plug blocking structure on the back end is changed to the end-face inclined-hole main oil channel structure on the front side, and the base auxiliary oil channel that is disposed in the original aluminium base is changed to a new auxiliary oil channel structure in which a channel is added on the upper end face of the base. The channel added on the upper end face of the base is used as the new auxiliary oil channel which is used as a carrier for connection, to implement oil auxiliary supply of the engine and accelerate to cool the connection effect with the oil passage, thereby increasing a product service life and reducing a product market failure rate and a customer complaint rate (a threaded spin-on plug structure in an old state is canceled) (the patent of a threaded spin-on plug structure of the DORMAN company is also avoided at the same time).

A filter cover sealing ring 607 is sleeved on the filter cover 603.

The oil inlet 7 is provided with an oil inlet sealing ring 106, the oil inlet sealing ring 106 is a nozzle sealing ring and seals the oil passage to prevent leakage, and the oil outlet 2 is provided with an oil outlet sealing ring 103. The first water outlet 3 and the second water outlet 4 are both provided with water outlet sealing rings 104 for sealing the water passage to prevent water leakage, and the oil return port 5 is provided with an oil return port sealing ring 105 for sealing the oil passage to prevent leakage.

The oil filter base 6 is provided with an oil return process hole, the oil return process hole is provided with an oil return port blocking screw 107, the oil return port blocking screw 107 is a G3/8 screw (3Pcs), and an end-face inclined-hole main oil channel blocking screw 108 is connected to an outer end port of the end-face inclined-hole main oil channel 8.

The oil filter base 6 is provided with a water passage process hole, the water passage process hole is provided with a water passage blocking screw 118 for blocking oil passage and water passage process holes, and the end-face inclined-hole main oil channel blocking screw 108 is connected to the outer end port of the end-face inclined-hole main oil channel 8.

The oil cooler 9 is fixed on the oil filter base 6 through a fastening bolt 901, the oil filter base 6 is provided with a mounting hole, and a base mounting screw rod 100 is disposed in the mounting hole and is connected to the engine. The fastening bolt 901 is used to tightly lock connection between the oil cooler 9 and the oil filter base 6, the fastening bolt 901 is a 6Pcs bolt, the base mounting screw rod 100 passes through the oil filter base 6 for connecting and tightly locking the assembly with the engine, and the base mounting screw rod 100 is a 5Pcs screw rod.

A flow port between the oil cooler 9 and the oil filter base 6 is provided with a cooler sealing ring 902 for sealing the oil passage to prevent oil leakage.

A temperature sensor 101 and a pressure sensor 102 are mounted at one end, away from the filter cover 603, of the oil filter base 6.

The oil filter base 6 is made of aluminium magnesium alloy. Aluminium magnesium alloy (ADC6). An internal oil passage structure of the oil filter base 6 is two parallel channels, a process hole at one end of the oil channel of the oil filter base 6 adopts a laser soldering process after aluminium profile alloy is used for lathing and a blocking member is tightly fit and pressed, and the threaded spin-on plug structure in an original state is canceled.

The auxiliary oil channel 609 is provided with a sealing groove 610 along an edge, and an auxiliary oil channel sealing ring 611 is pressed in the sealing groove 610.

The oil filter base 6 is of an L-shaped integral structure.

What is claimed is:

1. An improved structure of an oil channel of an oil filter base assembly in a vehicle, comprising an oil filter base, wherein a lower portion of the oil filter base is provided with an oil inlet, an oil outlet, and an oil return port, an end portion of the oil filter base is provided with an antifreeze solution water inlet, a bottom portion is provided with a first water outlet and a second water outlet that are communicated with the antifreeze solution water inlet, a filter cartridge and a bypass valve are mounted in one end of the oil filter base, a filter cover is connected to an end portion of one end, close to the bypass valve, of the oil filter base, and an oil cooler is mounted on an upper portion of one end, away from the filter cartridge, of the oil filter base, wherein a front side face of the oil filter base is provided with an end-face inclined-hole main oil channel, an upper end face of the oil filter base is in contact with the oil cooler and is provided with two auxiliary oil channels disposed in parallel, the auxiliary oil channels are not parallel to a longitudinal direction of the oil cooler, and the end-face inclined-hole main oil channel is communicated with the auxiliary oil channels.

2. The improved structure of an oil channel of an oil filter base assembly in a vehicle according to claim 1, wherein a filter cover sealing ring is sleeved on the filter cover.

3. The improved structure of an oil channel of an oil filter base assembly in a vehicle according to claim 1, wherein the oil inlet is provided with an oil inlet sealing ring, and the oil outlet is provided with an oil outlet sealing ring; and the first water outlet and the second water outlet are both provided with water outlet sealing rings, and the oil return port is provided with an oil return port sealing ring.

4. The improved structure of an oil channel of an oil filter base assembly in a vehicle according to claim 3, wherein the oil filter base is provided with an oil return process hole, the oil return process hole is provided with an oil return port blocking screw, and an end-face inclined-hole main oil channel blocking screw is connected to an outer end port of the end-face inclined-hole main oil channel.

5. The improved structure of an oil channel of an oil filter base assembly in a vehicle according to claim 4, wherein the oil cooler is fixed on the oil filter base through a fastening bolt, the oil filter base is provided with a mounting hole, and a base mounting screw rod is disposed in the mounting hole and is connected to an engine.

6. The improved structure of an oil channel of an oil filter base assembly in a vehicle according to claim 5, wherein a flow port between the oil cooler and the oil filter base is provided with a cooler sealing ring.

7. The improved structure of an oil channel of an oil filter base assembly in a vehicle according to claim 6, wherein a temperature sensor and a pressure sensor are mounted at one end, away from the filter cover, of the oil filter base.

8. The improved structure of an oil channel of an oil filter base assembly in a vehicle according to claim 7, wherein the oil filter base is made of aluminium magnesium alloy.

9. The improved structure of an oil channel of an oil filter base assembly in a vehicle according to claim 8, wherein each of the auxiliary oil channels is provided with a sealing groove along an edge, and an auxiliary oil channel sealing ring is pressed in the sealing groove.

10. The improved structure of an oil channel of an oil filter base assembly in a vehicle according to claim 9, wherein the oil filter base is of an L-shaped integral structure.

* * * * *